US006581523B2

(12) United States Patent
Beal

(10) Patent No.: US 6,581,523 B2
(45) Date of Patent: Jun. 24, 2003

(54) POWDER-BASED DISC HAVING SOLID OUTER SKIN FOR USE IN A MULTI-COMPONENT AMMUNITION PROJECTILE

(75) Inventor: Harold F. Beal, Rockford, TN (US)

(73) Assignee: Doris Nebel Beal Intervivos Patent Trust, Pawleys Island, SC (US)

( * ) Notice: Subject to any disclaimer, the term of this patent is extended or adjusted under 35 U.S.C. 154(b) by 0 days.

(21) Appl. No.: 10/135,248

(22) Filed: Apr. 30, 2002

(65) Prior Publication Data

US 2002/0117074 A1 Aug. 29, 2002

Related U.S. Application Data

(63) Continuation-in-part of application No. 09/491,257, filed on Jan. 26, 2000, now Pat. No. 6,371,029.
(60) Provisional application No. 60/287,540, filed on Apr. 30, 2001.

(51) Int. Cl.[7] ..... F42B 12/02; F42B 12/74
(52) U.S. Cl. ..... 102/516; 102/506; 102/507; 102/517; 102/439

(58) Field of Search ..... 102/501, 506–510, 102/514–519, 529, 439

(56) References Cited

U.S. PATENT DOCUMENTS

| | | | | |
|---|---|---|---|---|
| 2,393,648 A | * | 1/1946 | Martin | 102/519 |
| 5,279,787 A | | 1/1994 | Oltrogge | |
| 5,847,313 A | | 12/1998 | Beal | |
| 6,371,029 B1 | * | 4/2002 | Beal | 102/516 |

* cited by examiner

*Primary Examiner*—Harold J. Tudor
(74) *Attorney, Agent, or Firm*—Pitts & Brittian, P.C.

(57) ABSTRACT

A projectile for gun ammunition of 50 caliber or less, the projectile including an outer jacket having a longitudinal centerline and which houses one or more cores made up of a powder or mixture of powders comprising a frangible disc including a central region thereof formed of a compressed unbonded quantity of particles of at least one metal powder and an outer peripheral skin defined by melded ones of said at least one metal powder particles. Manufacture of the disc, a projectile including the disc and a round of gun ammunition including the disc-containing projectile are disclosed.

12 Claims, 2 Drawing Sheets

POWDER-BASED DISC HAVING SOLID OUTER SKIN FOR USE IN A MULTI-COMPONENT AMMUNITION PROJECTILE

CROSS-REFERENCE TO RELATED APPLICATIONS

This application is a non-provisional application of provisional application Ser. No. 60/287,540, filed Apr. 30, 2001 which is a continuation-in-part of U.S. patent application Ser. No. 09/491,257, filed Jan. 26, 2000, entitled: POWDER-BASED DISC FOR GUN AMMUNITION HAVING A PROJECTILE WHICH INCLUDES A FRANGIBLE POWDER-BASE CORE DISPOSED WITHIN A METALLIC JACKET, now U.S. Pat. No. 6,371,029.

FIELD OF INVENTION

This invention relates to gun ammunition, and specifically to gun ammunition in which a round of the ammunition includes a casing which houses gunpowder and a projectile. More specifically, the present invention relates to multi-component projectiles for gun ammunition.

BACKGROUND OF INVENTION

In all gun ammunition wherein a projectile is propelled from a rifled barrel of a weapon, the projectile spins about its longitudinal axis (about its trajectory) at high speeds of rotation. Consequently, it is of major importance that the density of the projectile be uniform in any given plane taken normal to the longitudinal axis of the projectile so that the projectile does not wobble (nutate) as it is spinning to its target. Wobble of the projectile can adversely affect both the terminal ballistics of the projectile and, more importantly, the accuracy of delivery of the projectile to the target. Severe non-uniformity of the density distribution of the projectile about its longitudinal axis can result in jamming of the projectile within the gun barrel, or in less serious wobble, damage to the lands of the rifling of the gun barrel. Accuracy of delivery of the projectile to a target also dictates that the projectile be of consistent construction, including weight, from projectile to projectile so that a consistent given load of gun powder employed in each round of ammunition will ensure that each round of ammunition functions precisely like each other round of the ammunition. In certain situations, such as sniper fire, it is imperative that the shooter be confident that each round of ammunition will perform precisely like every other round of ammunition for a given weapon for the reason, among others, that the sniper commonly can only get off a single shot to his target. This same situation exists in sport hunting and in competitive shooting.

Of relatively recent vintage is a gun ammunition projectile which is fabricated from two or more metal powders. Commonly, the metal powders are die-pressed into a cylindrical geometry. Such pressed compacts are at times referred to as "cores". To form a projectile, a core is placed in a hollow cup-shaped metal jacket having one end thereof closed and its opposite end open for the receipt of the core. After the core has been placed in the jacket and seated against the closed end of jacket, the open end of the jacket, and that end of the core adjacent the open end of the jacket, are die-formed into an ogive. The formation of the ogive tends to partially crush that portion of the core which is involved in the formation of the ogive, generating unbonded metal powder adjacent the leading end of the projectile. In those projectiles where the ogive end of the projectile is not fully closed, this unbonded powder is free to escape from the projectile during handling of a round of ammunition, while the round is in a gun, and/or after the round has been fired and the projectile is traveling to a target. Whereas the quantity of unbonded metal powder adjacent the open end of the jacket will vary from a few particulates of metal powder to many particulates of metal powder, it is to be noted that even one loose metal particle escaping from the jacket can adversely affect the operation of the gas-operated bolt actuation mechanism of an automatic or semi-automatic weapon, or can create undue localized wear of the bore of a weapon, whether the weapon be a bolt action-type weapon or an automatic or semi-automatic weapon. Further, dislocation of a material quantity of metal powder particulates can adversely affect the spin stability of a powder-based projectile, hence adversely affect the accuracy of delivery of the projectile to an intended target.

In U.S. Pat. No. 5,789,698, the present inventor disclosed the use of a solid metal cap to be placed within the jacket adjacent the exposed end of the core prior to formation of the ogive. As the ogive is formed, this cap is also deformed and urged toward the open end of the jacket where it remains lodged in position to prevent the escape of metal powder from the ogive end of the projectile. In many applications, the formation of the ogive does not fully close the open end of the jacket, commonly for purposes related to the disintegration of the projectile upon striking its target.

Whereas solid metal caps are effective for their intended purpose, their cost of manufacture and/or other disadvantages have raised the need for a different cap. One such cap conceived by the present inventor is disclosed in copending U.S. patent application Ser. No. 09/491,257, filed Jan. 26, 2000, entitled: Powder-based Disc for Gun Ammunition Having a Projectile Which Includes a Frangible Powder-based Core Disposed Within a Metallic Jacket. The cap of this copending application comprises a metal powder, particularly a tin metal powder, which is die formed into a disc of a preselected diameter, and which is of uniform cross-sectional thickness, is uniform in density throughout the disc, and which is deformable when deployed in a projectile jacket with a core and the open (leading) end of the combination is die-formed to define an ogive on the leading end of the multi-component projectile.

SUMMARY OF INVENTION

In accordance with one aspect of the present invention, the inventor has discovered a frangible disc useful in small-bore gun ammunition (50 caliber or smaller) including a central region thereof formed of a compressed unbonded quantity of particles of at least one metal powder and an outer peripheral skin defined by melded ones of said at least one metal powder particles. The disc is formed from a compressed metal powder compact which is heat treated under controlled conditions such that, without materially altering the dimensional aspects of the disc, the outer peripheral margin of the disc is converted into a solid skin. This heat treated disc is employed in the usual manner in a multi-component projectile for gun ammunition.

One embodiment of a method for the formation of the skin-bearing powder-based disc comprises the steps of compacting, in a die cavity, a quantity of a metal powder into a self-supporting disc, heating this disc to a temperature and for a time whereupon only the powder particles disposed on the outer surface of the disc meld together to define a skin on the outer surface of the disc, but not to a temperature nor for a time whereupon sufficient quantities of powder particles become sufficiently fluid to overcome the surface tension of the melded particles and resultant deleterious deformation of the overall original geometry of the disc.

DETAILED DESCRIPTION OF INVENTION

Figure 12:
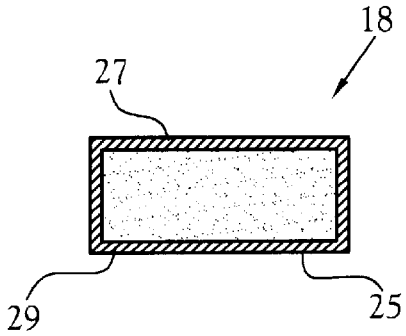
FIG. 12 is a sectional view of a powder-based disc having an outer skin layer in accordance with the present invention.
Figure 2:
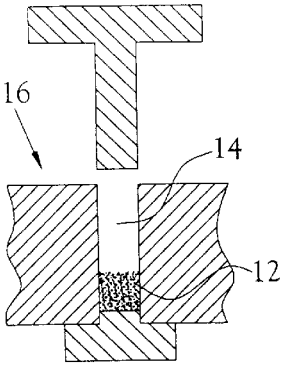
FIGS. 2–4 depict the various steps in the die-pressing of a metal powder into a self-supporting disc suitable for use in the present invention.
Figure 3:
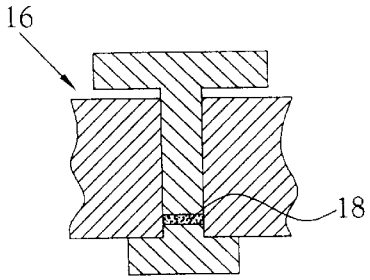
Figure 4:
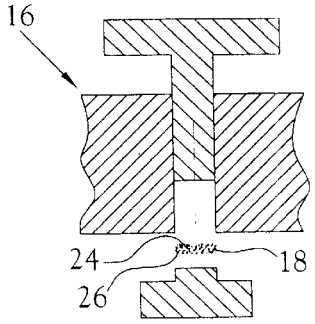

With reference to FIGS. 2–4, in the depicted embodiment of the method of the present invention, a quantity of a metal powder 12, or a mixture of metal powders, is pressed, at room temperature, in the cavity 14 of a die 16 to define a disc 18. This disc is of a preselected diameter suitable for receipt within an open-ended jacket 20 (see FIGS. 5 and 6) designed and sized for defining a projectile 22 (FIG. 8) for a given caliber of gun ammunition 24 (FIG. 9). The pressed disc 18 of the present invention is of uniform density throughout the disc, and is of a uniform thickness, and includes an outer skin 25 as depicted in FIG. 12. Moreover, its opposite sides 27,29 are essentially planar and parallel to one another.

Figure 10:
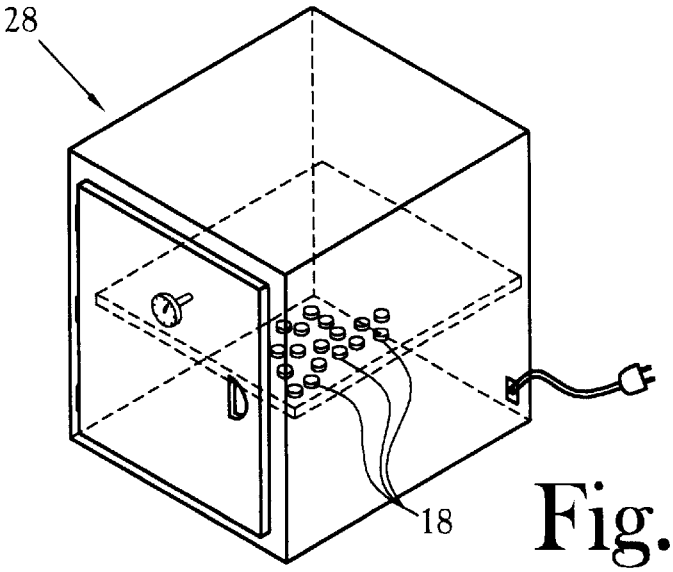
FIG. 10 is a representation of an oven suitable for heating the discs of the present invention.

In accordance with one aspect of the present invention, the pressed disc 18, after removal from the die 16, is placed in an oven 28 (FIG. 10) which is initially at room temperature. Depending on the thickness and diameter of the disc, it is heated over a period of time to a temperature at which the outer peripheral margin of the disc to commence a type of melding of those metal powder particles disposed adjacent the outer peripheral surface of the disc, that is, those particles of metal powder which are disposed on the outer margin of the disc meld together. Thereupon, and before the melding process has proceeded to the point where the surface tension of the heated disc is overcome and the metal commences to flow, the oven is turned off and the door 30 thereof is opened to room temperature. Under these conditions, the melding process is halted and the heated disc is quenched to define an outer skin of substantially solid metal on essentially all of the outer periphery of the disc. The thickness of the skin produced on the outer peripheral surface of the disc may vary from a thickness generally equal to the diameter of a single metal powder particle to a thickness generally equal to the collective diameters of several single powder particles. For example, where the average particle size of the metal powder particles making up the disc is about 200 to 325 mesh, the thickness of the skin may vary from about a single particle diameter in the range of between about 0.0029 (200 mesh) to about 0.0017 inch (325 mesh) up to a range of between about 5 to about 10 times the foregoing range values, such as where the skin extends to a thickness of 5 to 10 average particle diameters.

It has been found that by gradual heating of the pressed disc to approximately the melting point of the metal of which the disc is formed, one can halt the melding process at that point in time and temperature where the surface tension of the metal still retains the geometry of the disc. Several advantages accrue by the present method. The density distribution of the disc radially outwardly from the center of the disc, though it may vary from a first density adjacent the center of the disc to a second density adjacent the periphery of the disc, remains uniform around the center of the disc and through the thickness of the disc. This uniformity of density distribution is critical for successful implementation of the disc in a projectile. Specifically, the present inventor has found that very small, even minute, deviations in the uniformity of distribution of the density in a direction radially of a disc can destroy the spin stability of a projectile containing the disc and thereby essentially destroy the accuracy of delivery of the projectile to its target. This effect of the density distribution within the disc can be readily understood when it is recognized that a gun projectile leaving the rifled barrel of a rifle having a seven twist is spinning about its longitudinal axis at several hundred thousand revolutions per minute. Spinning projectiles will travel more truly along their trajectory than non-spinning projectiles. However, if a projectile experiences nutation (wobble of the projectile about its own longitudinal centerline) along its trajectory, among other things, the projectile no longer follows its intended trajectory and it "wanders" and most commonly misses its target. Even small, even minute, variations in the uniformity of the distribution of the density of a projectile, radially of its longitudinal centerline, encourages nutation of the fired spinning projectile. Thus, any non-uniformity of the distribution of the density of the disc radially within the disc is detrimental to the accuracy with which a projectile may be delivered to a target.

Figure 1:
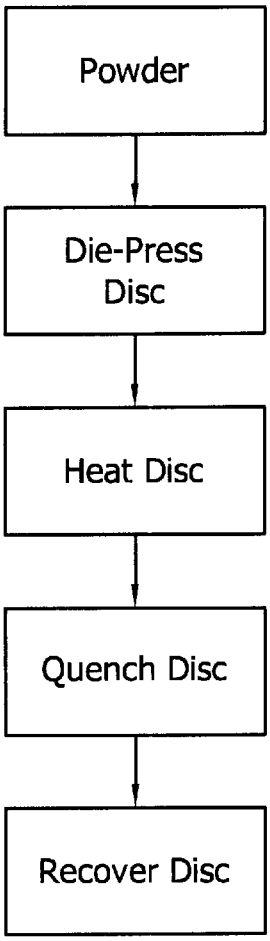
FIG. 1 is schematic flow diagram of one embodiment of the method of the present invention.

In one example of the present method, depicted generally in FIG. 1, a precisely measured quantity of tin powder is loaded into a die cavity suitable for forming a disc of precise and uniform diameter, and pressed at room temperature into a self-supporting compact having a uniform desired thickness and density throughout the disc. The selected density of the disc may be chosen to provide a more or less frangible disc or to provide a substantially non-frangible disc depending upon the anticipated target. Similarly, the thickness of the disc may be chosen to provide desired performance of the disc during manufacture of a projectile and/or desired terminal ballistics of the projectile.

Preferably, the die-pressed tin metal powder was substantially free of oxidation. It was pressed at room temperature, using a pressure of about 16,000 psi, into a disc having a diameter of 0.191 inch and a thickness of 0.030 inch. The opposite sides of the disc were planar and essentially parallel to one another. The density of the disc was substantially uniform throughout the disc. This disc was placed in an electrically-heated oven which was initially at room temperature. With the door of the oven closed, the temperature within the oven was increased, over a time period of about 45 minutes, to approximately 430° F. The heating of the disc was visually monitored and when the compact within the oven took on a dark blue surface coloration, and before the surface tension of the liquefying metal powder was overcome such that flow of the metal occurred, the oven was turned off and the door of the oven was immediately opened to room temperature, thereby quenching the disc.

After cooling to about room temperature, the disc was removed from the oven and examined for conformity to its desired diameter and for uniformity of distribution of its density radially of the disc. The diameter of the disc remained within acceptable limits for its intended use and there was found to be excellent uniformity of distribution of the density of the disc radially of the disc.

Figure 5:
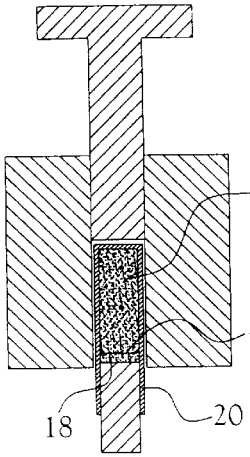
FIG. 5 depicts the loading of a core and a disc into a metal jacket.

As depicted in FIG. 5, the disc 18 was inserted into a copper metal jacket 20 for a .223 cal. projectile, which previously had received a cylindrical die-pressed metal powder core 52 therein. The disc, as initially positioned within the jacket was disposed overlying the outboard face 40 of the cylindrical core. Thereafter, the open (leading) end 32 of the jacket was disposed in a die cavity 38 designed to define a seven ogive 30 on the leading end of the projectile 22. This die-forming operation deformed the disc into a substantially hollow, general hemispherical, i.e. cup-shaped, body, within the jacket. Simultaneously a portion 50 of the outboard (leading) end of the cylindrical core was caused to flow into the hollow concavity 54 of the deformed disc, and both the disc and the powder particulates of the core were caused to substantially fill the ogive end of the jacket, leaving, in one embodiment, a relative small opening, a i.e. a meplat cavity, 56 at the leading end of the projectile. In the present example, the meplat cavity was 0.1 inch in depth and about 0.062 inch in diameter at the open end of the projectile. In particular, the disc of the present invention was noted to yield uniformly as it was urged into the ogive geometry, with no fracture thereof and no material deviation from uniform distribution of density radially from the longitudinal centerline of the projectile. As depicted, the deformed disc was disposed most outwardly of the jacket and defined a seal across the full cross-section of the ogive to preclude the escape therepast of any loose metal powder particles emanating from the crushed end 50 of the core.

In any event, the skin-bearing disc of the present invention is deformable to the extent required to permit the die-forming of an ogive on a projectile which contains the disc adjacent the leading end of a core disposed within the jacket, without destruction of the integrity of the disc itself. The limit of deformation of the disc is that deformation which will form the disc into at least a substantially hollow hemispherical geometry without material disintegration of the disc. In this latter respect, the present inventor has found that use of a blend of particle sizes of the powder from which the disc is formed provides for apparent flow within the powder-based disc in much the same manner that solid metal flows when deformed, thereby imparting to the powder-based disc the ability to withstand the required deformation without disintegration of the disc. Of importance in obtaining a deformable powder-based disc is that the tin be substantially free of surface oxidation of the powder particles. Where such surface oxidation is present, it may be driven off by heating the tin powder. Alternatively, greater die-pressing pressure may be employed in certain circumstances unless the degree of oxidation of the tin is unsuitably pervasive.

Other projectiles of .223 caliber (5.56 mm) of seven ogive were prepared in like manner and the same were fired from conventional law enforcement and military weapons such as the M16M4 military rifle having seven twist barrels. Firings were from weapons having barrel lengths of 10 inches, 14.5 inches and 20 inches. The jackets, cores, caps and the relative positions of the cores and caps were constant for all the fired projectiles. Specifically, the jackets were of copper metal and each of the cores was formed from a cold-pressed mixture of 65% by wt. of tungsten metal powder and 35% by wt. of tin metal powder, along with about 0.1% by wt. of a non-metal powder, the total percentages of all powders equaling 100%. All the projectiles exhibited excellent spin stability and accuracies of about one minute of angle at 1000 yards.

Projectiles were prepared using discs of 0.090 inch, 0.030 inch, and 0.020 inch thicknesses and fired from the same weapon. Notably it was found that projectiles prepared with a 0.090 inch thick disc, at 100 yards, would not penetrate AR500 armor plate, whereas like projectiles prepared with 0.030 inch or 0.020 inch thick disc would penetrate the same armor plate at 100 yards, an unexpected result. Accordingly, depending upon the desired ballistics coefficient for a given projectile, different thickness of the disc may be employed to obtain such desired results. More specifically, the disc of the present invention, in thicknesses of less than about 0.090 inch are frangible upon the projectile striking a solid or semi-solid target, including in certain embodiments, frangible when striking a conventional gel block or animal tissue.

In an alternative embodiment, multiple discs of the present invention may be employed in a single jacket, such the embodiment wherein two powder-based cores are disposed in tandem within a single jacket. In this latter embodiment, a disc of the present invention may be disposed between the abutting surfaces of the two cores, and a further disc of the present invention may be disposed within the ogive portion of the projectile.

In particular, the present inventor has discovered that a metal powder having a blend of particles that provides a particle size distribution which includes a major portion of the particles thereof of a relatively smaller size and a minor portion of the particles of a relatively larger size is preferable. In one example, when employing tin powder, a preferable blend includes about 5.6% by wt., of powder particles of a size between about 100 and 200 mesh, about 66.4% by wt., of powder particles of a size between about 200 and about 325 mesh. The remainder of the particles of the blend preferably are of smaller than about 325 mesh. This blend of powder may be pressed within the die 16 at a pressure of between about 12,000 psi and about 18,000 psi to provide a self-supporting compact of right cylindrical geometry with its perimetral edges being free of extraneous material and being deformable into at least about a hollow hemispherical geometry without material disintegration thereof when incorporated into the jacket with one or more cores and with said disc being initially oriented with its planar faces disposed substantially normal to the longitudinal centerline 23 of the jacket.

This tin powder, in a substantially non-oxidized state, when pressed in a die at room temperature, at a pressure of between about 16,000 and about 18,000 psi is formed into a self-supporting compact. Other metal powders, such as zinc, iron, lead, magnesium, bismuth copper, aluminum or mixtures of these or similar relatively light-weight metal powders, including alloys thereof, may be employed in the manufacture of the disc of the present invention. As commonly available from commercial sources, the individual particles of these powders are non-spherical in geometry.

Figure 6:
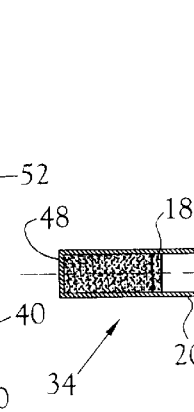
FIG. 6 depicts a metal jacket having a core and disc disposed therein and prior to the definition of an ogive at the open end of the jacket.
Figure 7:
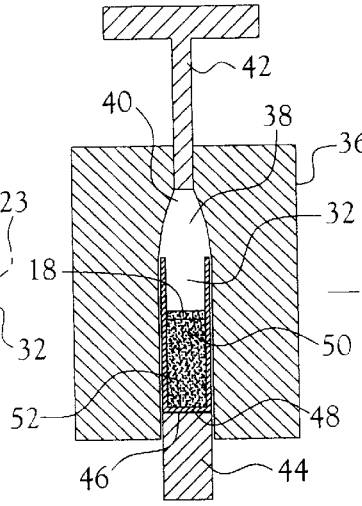
FIG. 7 depicts the die-forming of an ogive at the open end of the jacket depicted in FIG. 6.
Figure 8:
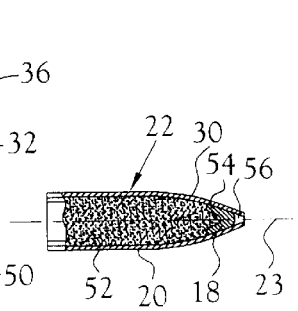
FIG. 8 depicts a projectile formed employing the method of the present invention.
Figure 9:
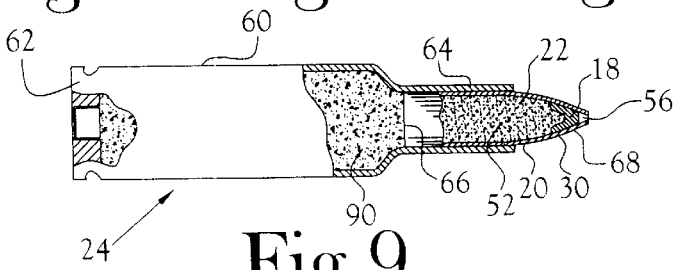
FIG. 9 is a representation of a round of gun ammunition embodying a projectile as depicted in FIG. 8.

Referring to FIGS. 6–8, for formation of an ogive 30 on the leading open-end 32 of the jacket 20, the jacket/core/disc combination 34 is loaded into a further die 36 having a die cavity 38 which defines the desired ogive geometry. The apex 40 of the ogive geometry of the die cavity is closed by a knock-out punch 42. Once the jacket/core/disc combination is inserted into the die cavity of the die 36, a further punch 44 is employed to apply pressure to the outer face 46 of the closed end 48 of the jacket, thereby urging the jacket/core/disc combination into the die cavity 38. This action causes the leading open end 32 of the jacket, the leading end 50 of the core 52, and the disc 18 to be urged radially inwardly of the die cavity 38 as the jacket is swaged into conformity with the ogive geometry of the die cavity. This radial and longitudinal pressure applied to the disc and leading end of the core causes the disc to assume a generally hollow hemispherical geometry (see FIGS. 8 and 9) and causes the leading end 50 of the core to flow radially and longitudinally relative to the jacket centerline 23. A portion of the core thus flows into the hollow hemispherical disc to substantially fill this hollow. Notably, the flow of the core and the disc has been found to take place substantially uniformly radially and longitudinally relative to the centerline 23 of the jacket (which is also being deformed at its open leading end). The result has been found to be a projectile which is of substantially uniform density in any given plane taken normal to the longitudinal centerline of the jacket. As noted hereinabove, the overall density of any given plane taken normal to the longitudinal centerline of the jacket may vary relative to the density of other given planes which also are taken normal to the longitudinal centerline of the jacket. This variation in density from plane to plane, however, does not adversely affect either the flight of the projectile to a target. Importantly however, this variation in the plane to plane density has been found to enhance the terminal ballistics of those projectiles which desirably are frangible when striking a solid or semi-solid target. For example, contrary to the tendency of solid discs to resist disintegration, and instead to tend to non-controllably move as a unit longitudinally of the jacket and into the core itself upon the projectile impacting a target, the present powder-based disc does not exhibit such tendencies, and in fact, has been found to enhance the desired frangibility of the projectile. Such enhancement often takes the form of more uniformity of dispersion of the ranged projectile, hence more predictable terminal ballistics of the projectile, as well as enhanced uniformity of performance from projectile to projectile, hence between rounds of a given gun ammunition.

Figure 11:
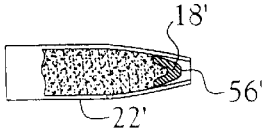
FIG. 11 is a representation of an alternative embodiment of a projectile embodying various features of the present invention.

Referring to FIG. 8, in one embodiment of a projectile 22 including a powder-based disc 18 in accordance with the present invention, the jacket 20 may be loaded with a core 52 and disc 18 designed to cause a portion of the core plus the disc to substantially fill the interior volume of the jacket when the jacket/core/disc combination is die formed to provide an ogive on the leading end of the jacket. In this instance, the disc may be positioned to substantially close the open end 32 of the jacket as depicted in FIG. 8, defining a relatively small meplat cavity 56. This embodiment provides a projectile 22 wherein the terminal ballistics of the projectile are altered to cause the jacket to disintegrate less readily than if there is a larger meplat cavity 56' left within the leading end of the jacket as is depicted in the projectile of FIG. 11. A projectile as depicted in FIG. 8, for example, can be made to penetrate a target a greater distance before fully disintegrating.

Employing the concepts of the present invention, one is provided with the option of choosing from a great range of diameters and thicknesses of the disc through selection of the diameter of the die cavity employed in pressing the disc from its base powder. Likewise, the density of the disc, hence its contribution to the terminal ballistics of the projectile, may be selected through choice of the amount of powder which is pressed into a given size disc employing a given pressing pressure. Further, different thickness of discs may be employed. Accordingly, the present invention represents considerable savings in time and cost for the manufacture of a given projectile, as well as cost savings over the time-consuming and relatively costly pretreatment required for the solid discs of the prior art. Also as noted, the uniformity of deformation of the present discs is improved over the prior art metal discs, thereby yielding a projectile which can be delivered more accurately and which can be manufactured with consistent performance characteristics from round to round of the gun ammunition.

With reference to FIG. 9, one embodiment of a round of gun ammunition 24 which incorporates therein a powder-based disc 18 of the present invention includes a case 60 having a trailing end 62 and an open leading end 64. A projectile 22 is disposed within the open end of the case. The depicted projectile includes a jacket 20 having a closed trailing end 66 and a leading end 68 which defines an ogive 30. The interior volume of the jacket is filled with a compressed core 52 of a mixture of metal powders, such as tungsten and tin metal powders and a deformed disc 18. In the manufacture of the projectile, the disc was planar, disposed within the jacket and extended diametrically of the jacket. Upon formation of the ogive 30, the disc is squeezed toward the leading end of the jacket and is deformed into a generally hollow hemispherical geometry. As depicted, the hollow of the deformed disc is filled with metal powders from the core. In the depicted embodiment, the disc effectively closes the leading end of the projectile. Gun powder 90 is loaded into the case prior to the placement of the projectile in the leading end of the case. As desired, the volume of the core and the disc may be chosen such that there remains an unfilled portion of the jacket adjacent its leading end, defining a meplat cavity 56, i.e., hollow point projectile.

Whereas the present invention has been described in conformity with the best mode presently known to the inventor, it will be recognized by a person skilled in the art that modifications in the invention may be made without deviating from the invention as set forth in the claims appended hereto.

What is claimed:

1. In a projectile for gun ammunition of 50 caliber or less, the projectile including an outer jacket having a longitudinal centerline a leading end and a closed trailing end and which houses at least one core made up of a compressed powder or mixture of powders and having a trailing end and a leading end which is disposed adjacent the leading end of the jacket, the improvement comprising a frangible disc including a central region thereof formed of a compressed unbonded quantity of particles of at least one metal powder and an outer peripheral skin extending substantially about the entire outer surface of said disc and defined by melded ones of said at least one metal powder particles said disc being disposed within the jacket adjacent the leading end of the jacket and in contact with the leading end of the at least one core.

2. The improvement of claim 1 wherein said frangible disc, prior to its insertion into the jacket, is of a substantially right cylindrical geometry with its perimetral edges being free of extraneous material.

3. The improvement of claim 1 wherein said skin includes a thickness defined by the average particle size of said particles of said at least one metal powder.

4. The improvement of claim 1 wherein said skin thickness is substantially equal to multiples of the average particle size of said particles of said at least one metal powder.

5. The improvement of claim 1 wherein said thickness of said skin is within a range of between substantially the average particle size of said particles of said at least one metal powder and ten multiples of the average particle size of said particles of said at least one metal powder.

6. The improvement of claim 1 wherein said disc comprises a mixture of metal powders or alloys thereof.

7. The improvement of claim 1 wherein said disc is formed from powder particles of tin, zinc, lead, copper, magnesium, aluminum or bismuth or mixtures of said powder particles or alloys of one or more of said powder particles.

8. The improvement of claim 1 wherein said disc is deformable into a generally hollow hemispherical geometry without material disintegration thereof when incorporated into the jacket with one or more cores.

9. The improvement of claim 1 wherein said particles of said at least one metal powder are non-spherical in geometry.

10. A round of gun ammunition comprising a projectile in accordance with claim 1.

11. A round of gun ammunition comprising a projectile including a jacket having a closed trailing end and an open leading end, at least one core formed of compressed metal powder or mixture of metal powders located within the jacket, and a frangible disc including a central region thereof formed of a compressed unbonded quantity of particles of at least one metal powder and an outer peripheral skin extending substantially about the entire outer surface of said disc and defined by melded ones of said at least one metal powder particles, said disc being disposed within said leading end of said jacket in contact with a leading end of the at least one core.

12. The round of gun ammunition of claim 11 wherein said disc within said leading end of said jacket is deformed into a generally hollow hemispherical geometry and with the hollow thereof facing inwardly of the projectile.

* * * * *